US011258215B2

(12) United States Patent
Chang et al.

(10) Patent No.: US 11,258,215 B2
(45) Date of Patent: Feb. 22, 2022

(54) HIGH VOLTAGE CONNECTOR

(71) Applicants: SOLTEAM ELECTRONICS (DONG GUAN) CO., LTD., Dong Guan (CN); SOLTEAM ELECTRONICS (SU ZHOU) CO., LTD., Wu Jiang (CN); Solteam Incorporation, Taoyuan (TW)

(72) Inventors: Chun-Yun Chang, Taoyuan (TW); Ying-Sung Ho, Taoyuan (TW); Ta-Feng Yeh, Taoyuan (TW); Cheng-Wei Lu, Taoyuan (TW); Chi-Yu Chu, Taoyuan (TW)

(73) Assignees: SOLTEAM ELECTRONICS (DONG GUAN) CO., LTD.; SOLTEAM ELECTRONICS (SU ZHOU) CO., LTD.; SOLTEAM INCORPORATION

( * ) Notice: Subject to any disclaimer, the term of this patent is extended or adjusted under 35 U.S.C. 154(b) by 3 days.

(21) Appl. No.: 16/945,896

(22) Filed: Aug. 2, 2020

(65) Prior Publication Data

US 2021/0281027 A1 Sep. 9, 2021

(30) Foreign Application Priority Data

Mar. 4, 2020 (CN) ..... 202020253494.5

(51) Int. Cl.
*H01R 13/64* (2006.01)
*H01R 24/66* (2011.01)
(Continued)

(52) U.S. Cl.
CPC ..... *H01R 24/66* (2013.01); *H01R 13/50* (2013.01); *H01R 13/5202* (2013.01); *H01R 13/631* (2013.01); *H01R 13/6581* (2013.01)

(58) Field of Classification Search
CPC ..... H01R 23/7073; H01R 13/5219; H01R 13/5221; H01R 13/5208; H01R 13/5202; H01R 13/631; H01R 13/6581; H01R 13/50; H01R 13/74; H01R 13/65802; H01R 13/658; H01R 33/00
(Continued)

(56) References Cited

U.S. PATENT DOCUMENTS 6,447,311 B1 * 9/2002 Hu ..... H01R 13/658 439/108
7,597,580 B1 * 10/2009 Advey ..... H01R 13/502 439/272

(Continued)

*Primary Examiner* — Thanh Tam T Le

(57) ABSTRACT

A high voltage connector is disclosed. The high voltage connector principally consists of a housing body, a shielding case, a plurality of L-shaped conductive terminals, two L-shaped signal terminals, and a seal ring. The housing body is provided with a terminal accommodating body therein, and the shielding case is embedded in the housing body for covering the terminal accommodating body. Particularly, four guide slots are formed on a lateral side of the terminal accommodating body, four prop blocks are respectively formed in the four guide slots, and the shielding case is designed to have four prop members. In case of the shielding case being disposed to cover the terminal accommodating body, the four prop members slide in the four guide slots, and then are consequently stopped by the four prop blocks, thereby being fixed in the housing body.

8 Claims, 6 Drawing Sheets

(51) Int. Cl.
*H01R 13/6581* (2011.01)
*H01R 13/50* (2006.01)
*H01R 13/52* (2006.01)
*H01R 13/631* (2006.01)

(58) Field of Classification Search
USPC .... 439/79, 271–275, 548, 556, 559, 607.27, 439/607.28, 607.47
See application file for complete search history.

(56) References Cited

U.S. PATENT DOCUMENTS 8,109,791 B2 * 2/2012 Kameyama ..... H01R 23/6873 439/607.37
8,167,634 B2 * 5/2012 Fujiwara ..... H01R 13/748 439/271
8,202,120 B2 * 6/2012 Ko ..... H01R 13/6581 439/607.35
8,262,413 B2 * 9/2012 Fujiwara ..... H01R 13/6596 439/607.28
8,764,481 B2 * 7/2014 Matsumoto ..... H01R 13/4223 439/595
8,801,463 B2 * 8/2014 Tan ..... H01R 13/521 439/607.04
8,851,935 B2 * 10/2014 Yoshioka ..... H01R 4/023 439/694
8,992,245 B2 * 3/2015 Higuchi ..... H01R 13/5202 439/272
8,992,249 B2 * 3/2015 Kobayashi ..... H01R 13/6591 439/548
9,437,956 B2 * 9/2016 Fukami ..... H01R 43/24
10,396,486 B2 * 8/2019 de Chazal ..... H01R 13/4368
10,454,199 B1 * 10/2019 Christiano ..... H01R 13/4368
10,594,071 B2 * 3/2020 Kamemura ..... H01R 13/5202
10,998,663 B2 * 5/2021 Kondo ..... H01R 13/521

* cited by examiner

HIGH VOLTAGE CONNECTOR

BACKGROUND OF THE INVENTION

1. Field of the Invention

The present invention relates to the technology field of Automotive connector, and more particularly to a high voltage connector used in electric vehicle chargers.

2. Description of the Prior Art

A conventional connectors mainly provide power and signal connection function for transmitting current and signals. With the development of electric vehicles and hybrid vehicles, the safety and convenience of charging equipment and power distribution equipment are extremely important.

In the electric automobile industry, in order to ensure the safety of electrical connection, the high voltage connector comprises a high voltage plug and a high voltage socket. The high voltage plug and the high voltage socket are inserted and pulled to realize the electrical connection between the two cables. Please refer to FIG. 1, which shows a stereo diagram of a conventional high voltage connector. As FIG. 1 shows, the high voltage connector 1' comprises: a outer flange 11', a conductive terminal group 12', and a signal terminal group 13' are disposed on the outer flange 11'. The outer flange 11' comprises a shielding case 111' for shielding caseing one end of the conductive terminal group 12' and the signal terminal group 13'. By such arrangement, the outer flange 11' forms a protruding angle through the shielding case cover 111' so that the conductive terminal group 12' and the signal terminal group 13' protrude from the outer flange 11'.

Although the conventional high voltage connector 1' has been widely used in the production of various charging equipment, the conventional high-voltage connector 1' has the following disadvantages in practical applications: the outer flange 11' does not have a corresponding guide. Therefore, when the conventional high-voltage connector 1' is connected to a connector, a gap is generated between the outer flange 11' and the connector, so that the conventional high-voltage connector 1' cannot be firmly fixed to the connector.

From above descriptions, it is understood that how to design and manufacture a high voltage connector with safety function has become an important issue. In view of that, the inventor of the present application has made great efforts to make inventive research thereon and eventually provided a high voltage connector.

SUMMARY OF THE INVENTION

The present invention discloses a high voltage connector, which principally comprises a housing body, a shielding case, a plurality of L-shaped conductive terminals, two L-shaped signal terminals, and a seal ring. The housing body is provided with a terminal accommodating body therein, and the shielding case is embedded in the housing body for covering the terminal accommodating body. Particularly, four guide slots are formed on a lateral side of the terminal accommodating body, four prop blocks are respectively formed in the four guide slots, and the shielding case is designed to have four prop members. In case of the shielding case being disposed to cover the terminal accommodating body, the four prop members slide in the four guide slots, and then are consequently stopped by the four prop blocks, thereby being fixed in the housing body.

In order to achieve the primary objective of the present invention, the inventor of the present invention provides an embodiment for the high voltage connector, comprising:

- a housing body, being provided with a terminal accommodating body therein, and having a recess portion, a first guiding member, and a second guiding member; wherein the terminal accommodating body is exposed out of the housing body from a first end side of the housing body, the recess portion being formed at the first end side of the housing body so as to surround the terminal accommodating body, and the first guiding member and the second guiding member being respectively formed on a first lateral side and a second lateral side of the housing body;
- a shielding case, being embedded in the housing body for covering the terminal accommodating body;
- a plurality of L-shaped conductive terminals, being fixed in the terminal accommodating body by an insert portion thereof;
- two L-shaped signal terminals, being fixed in the terminal accommodating body by an insert portion thereof; and
- a seal ring, being disposed in the recess portion.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE PREFERRED EMBODIMENTS

To more clearly describe a high voltage connector disclosed by the present invention, embodiments of the present invention will be described in detail with reference to the attached drawings hereinafter.

Figure 1:
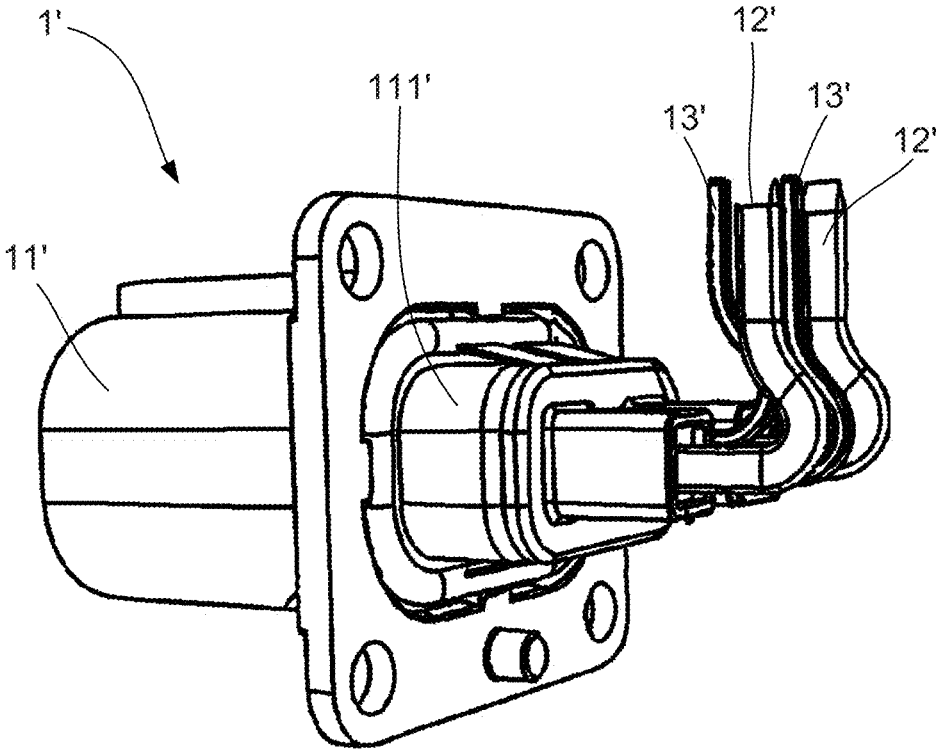
FIG. 1 (prior art)
FIG. 1 shows a stereo diagram of a conventional high voltage connector.
Figure 2:
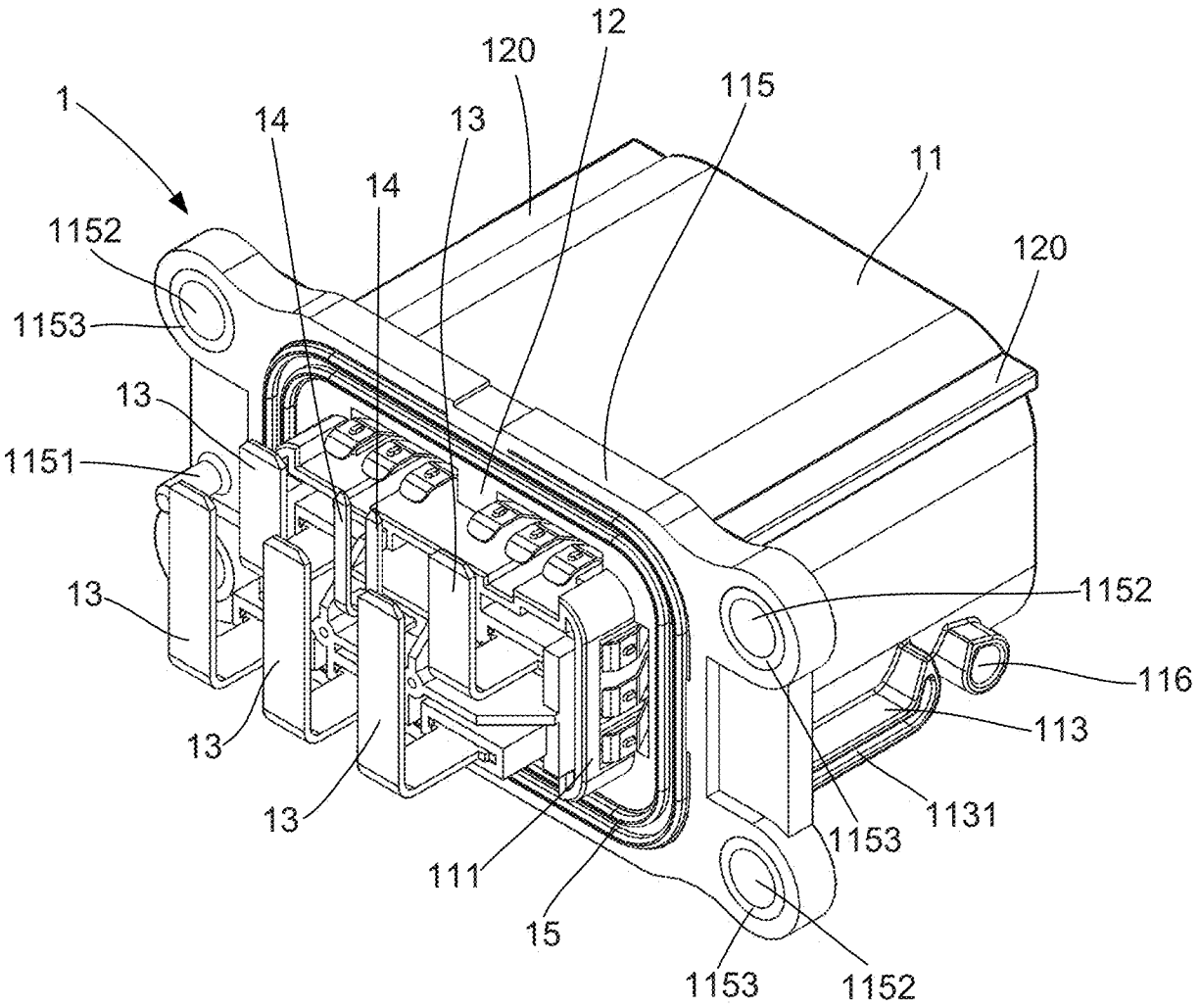
FIG. 2 shows a first stereo diagram of a high voltage connector according to the invention.
Figure 3:
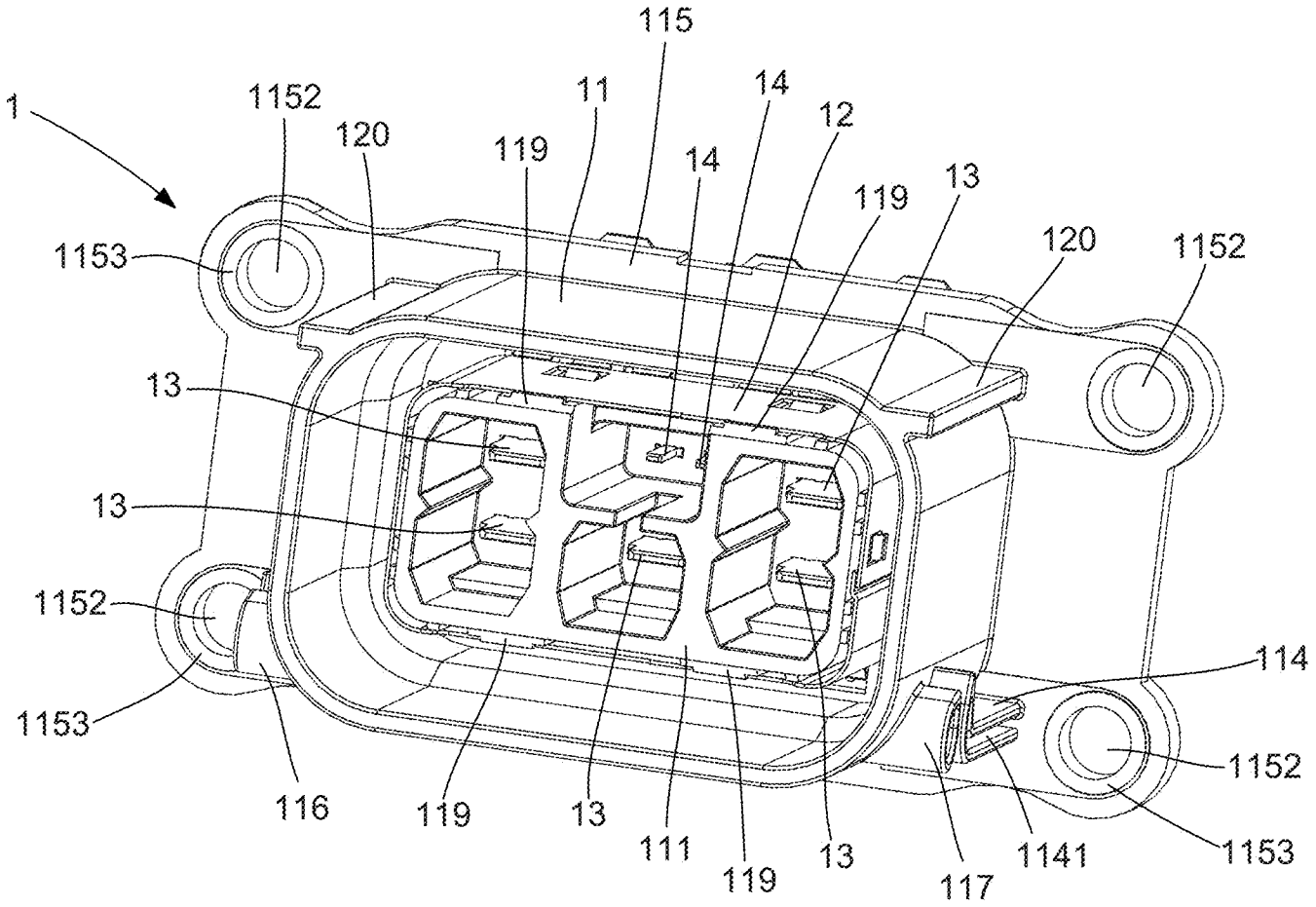
FIG. 3 shows a second stereo diagram of a high voltage connector according to the invention.
Figure 4:
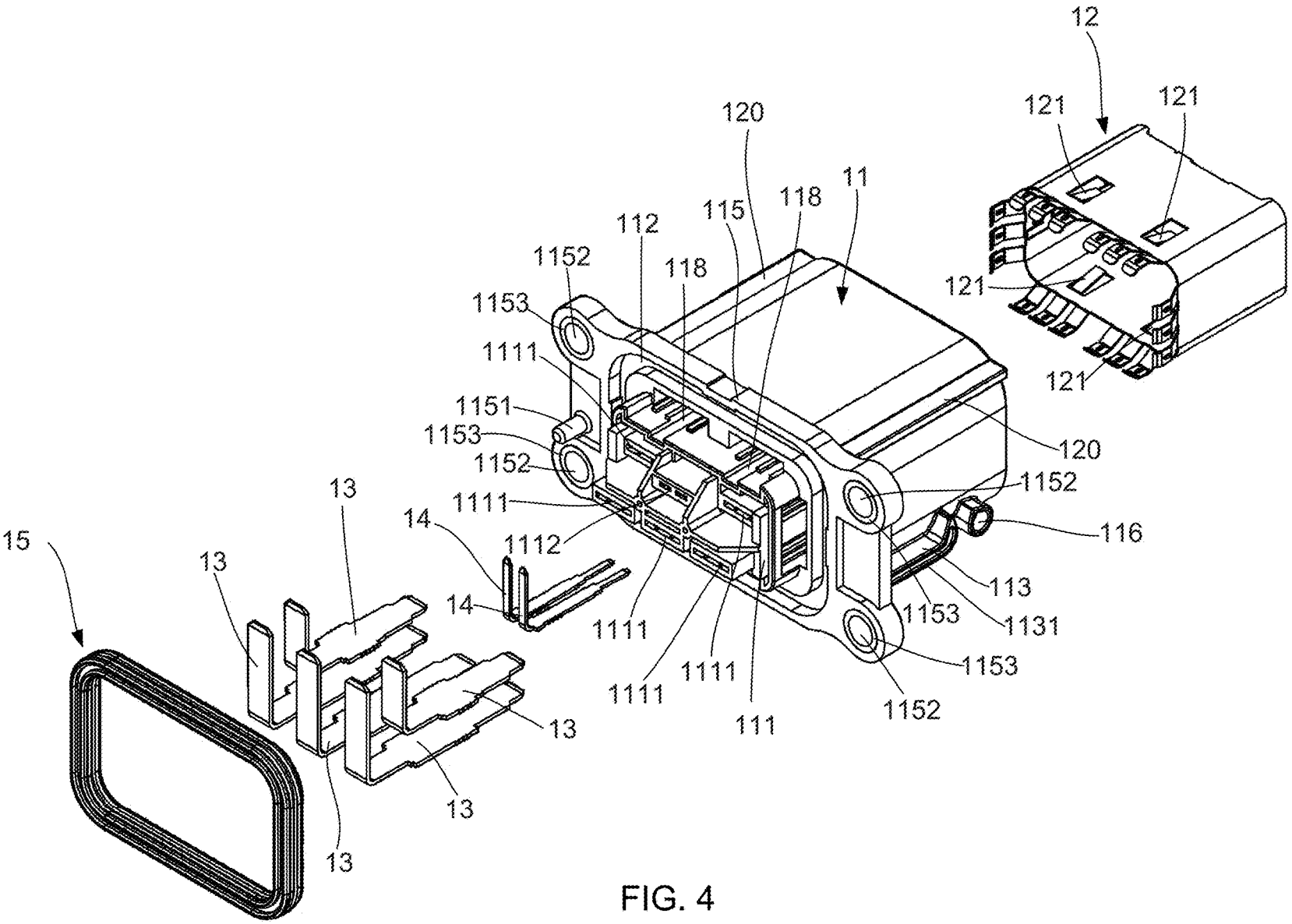
FIG. 4 shows a first exploded diagram of the high voltage connector according to the invention.
Figure 5:
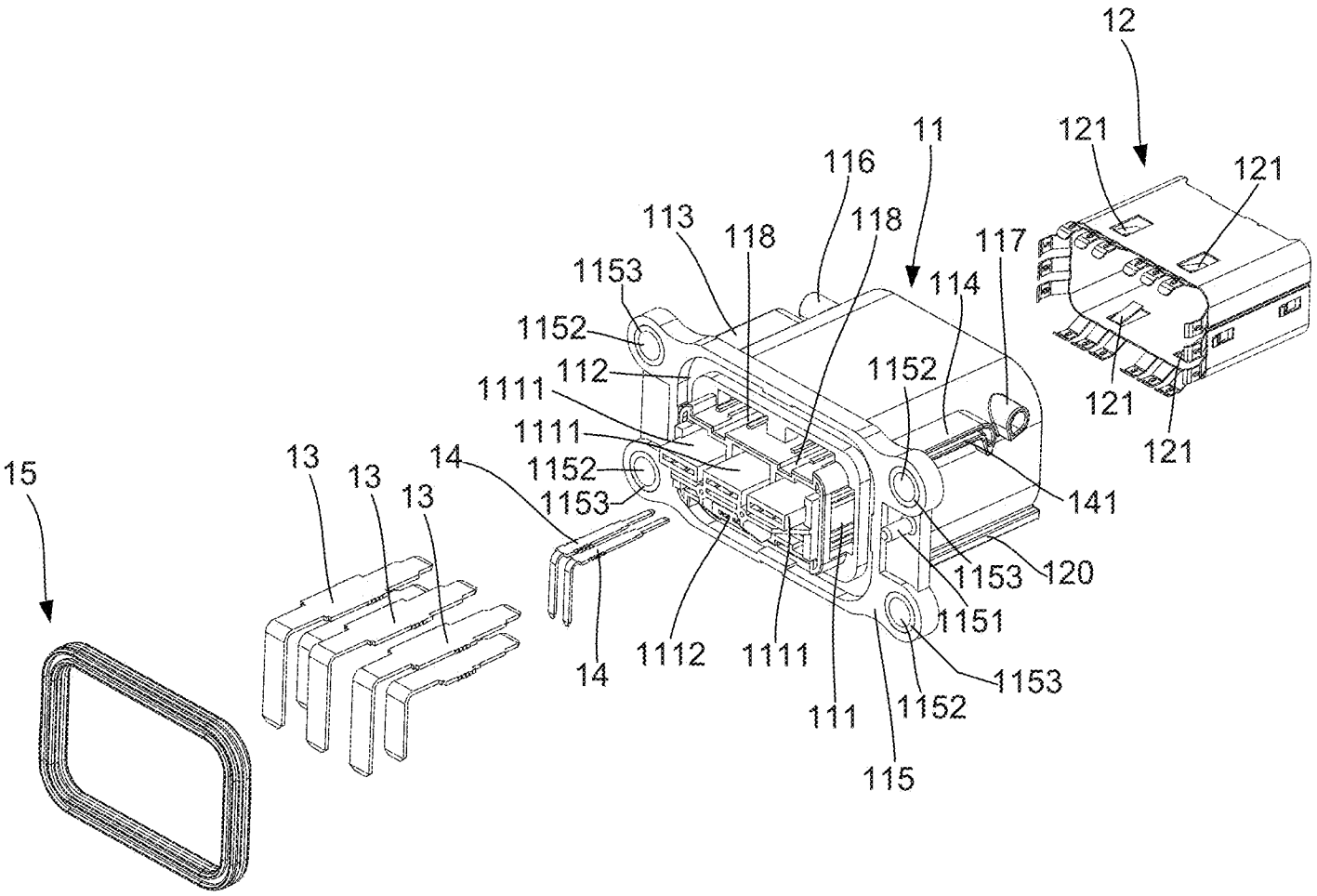
FIG. 5 shows a second exploded diagram of the high voltage connector according to the invention.

Please refer to FIG. 2, FIG. 3, FIG. 4, and FIG. 5, wherein FIG. 2 and FIG. 3 show stereo diagrams of a high voltage connector according to the invention, and FIG. 4 and FIG. 5 show exploded diagrams of the high voltage connector. The high voltage connector 1 comprises: a housing body 11, a shielding case 12, a plurality of L-shaped conductive terminals 13, two L-shaped signal terminals 14, and a seal ring 15. From FIG. 2 and FIG. 4, it is understood that the housing body 11 is provided with a terminal accommodating body 111 therein, and has a recess portion 112, a first guiding member 113, and a second guiding member 114. As described in more detail below, the terminal accommodating body 111 is exposed out of the housing body 11 from a first end side of the housing body 11, the recess portion 112 is formed at the first end side of the housing body 11 so as to surround the terminal accommodating body 111, and the first guiding member 113 and the second guiding member 114 are respectively formed on a first lateral side and a second lateral side of the housing body 11. Moreover, the shielding case 12 is embedded in the housing body 11 for covering the terminal accommodating body 111.

It is worth noting that, an outer flange 115 is formed at the first end side of the housing body 11, and is adjacent to the recess portion 112. a first guide block 116 is formed on the first lateral side of the housing body 11, and is adjacent to the first guiding member 113. Moreover, a second guide block 117 is formed on the second lateral side of the housing body 11, and is adjacent to the second guiding member 114. FIG. 2 and FIG. 4 also depict that, four guide slots 118 are formed on a lateral side of the terminal accommodating body, and four prop blocks 119 are respectively formed in the four guide slots 118.

Figure 6:
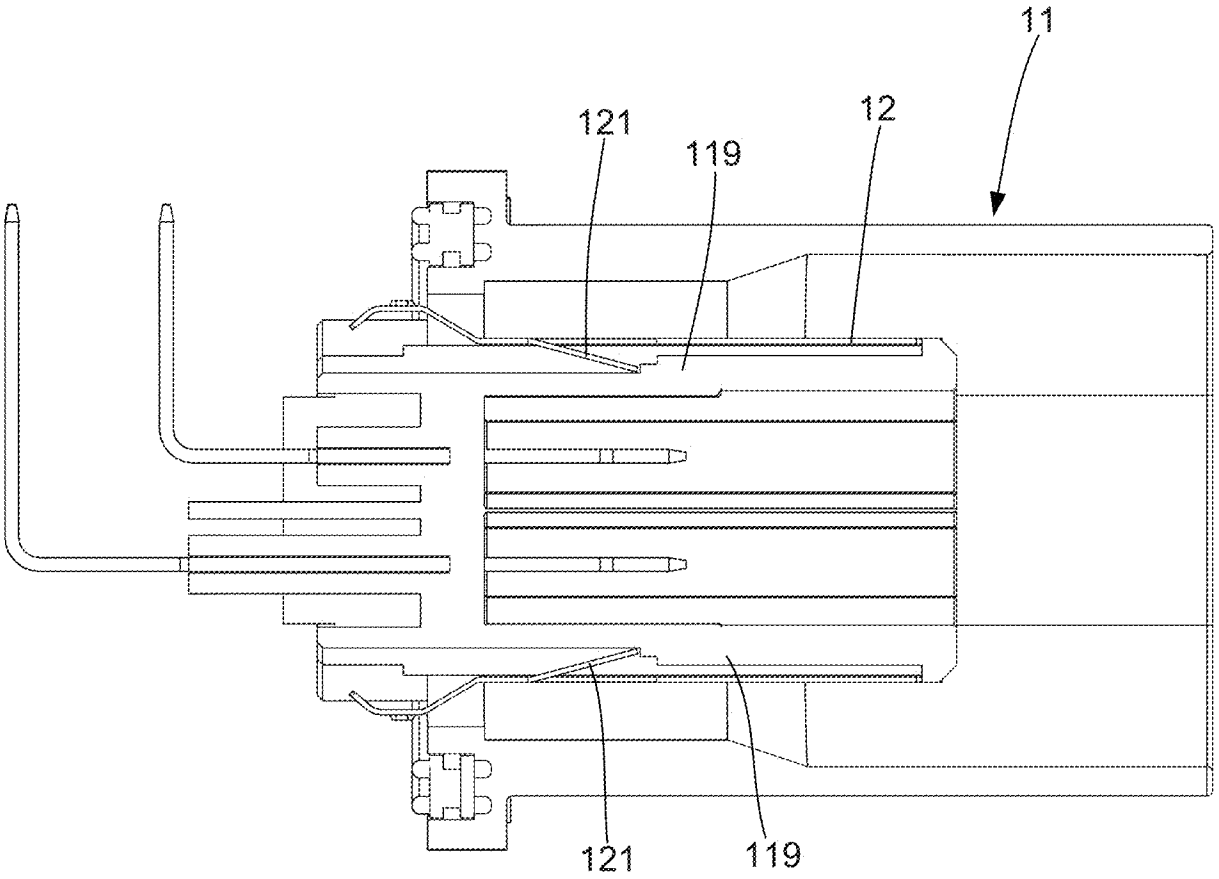
FIG. 6 show a cross-sectional view of the high voltage connector.

With reference to FIG. 2, FIG. 3, FIG. 4, and FIG. 5 again, and please simultaneously refer to FIG. 6 that shows a cross-sectional view of the high voltage connector. In one embodiment, the shielding case 12 is design to have four prop members 112, such that in case of the shielding case 12 being disposed to cover the terminal accommodating body 111, the four prop members 112 sliding in the four guide slots 118 so as to be consequently stopped by the four prop blocks 119, thereby being fixed in the housing body 11.

In addition, the terminal accommodating body 11 further comprises a plurality of first slots 1111 and a plurality of second slots 1112. The plurality of L-shaped conductive terminals 13 are correspondingly inserted into the plurality of first slots 1111 by an insert portion thereof, so as to be fixed in the terminal accommodating body 111. On the other hand, the two L-shaped signal terminals 14 are correspondingly inserted into the two second slots 1112 by the insert portion thereof, so as to be fixed in the terminal accommodating body 111.

Moreover, the seal ring 15 is disposed in the recess portion 112, the first guiding member 113 is provided with a first guide groove 1131 thereon, and the second guiding member 114 is provided with a second guide groove 1141 thereon. It is worth further explaining that, the outer flange 115 is provided with a fool proof portion 1151 and a plurality of connection holes 1152 thereon, wherein each of the plurality of connection hole 1152 is provided with a hole diameter adjusting sleeve 1153.

Therefore, through above descriptions, all constituting elements of the high voltage connector proposed by the present invention have been introduced completely and clearly.

The above description is made on embodiments of the present invention. However, the embodiments are not intended to limit scope of the present invention, and all equivalent implementations or alterations within the spirit of the present invention still fall within the scope of the present invention.

What is claimed is:

1. A high voltage connector, comprising:

a housing body, being provided with a terminal accommodating body therein, and having a recess portion, a first guiding member, and a second guiding member; wherein the terminal accommodating body is exposed out of the housing body from a first end side of the housing body, the recess portion being formed at the first end side of the housing body so as to surround the terminal accommodating body, and the first guiding member and the second guiding member being respectively formed on a first lateral side and a second lateral side of the housing body;

a shielding case, being embedded in the housing body for covering the terminal accommodating body;

a plurality of L-shaped conductive terminals, wherein each of the plurality of L-shaped conductive terminals has a first insert portion, and being fixed in the terminal accommodating body by the first insert portion thereof;

two L-shaped signal terminals, wherein each of the two L-shaped signal terminals has a second insert portion, and being fixed in the terminal accommodating body by the second insert portion thereof; and a seal ring, being disposed in the recess portion;

an outer flange, being formed at the first end side of the housing body, and being adjacent to the recess portion;

a first guide block, being formed on the first lateral side of the housing body, and being adjacent to the first guiding member;

a second guide block, being formed on the second lateral side of the housing body, and being adjacent to the second guiding member;

four guide slots, being formed on one side of the terminal accommodating body; and four prop blocks, being respectively formed in the four guide slots.

2. The high voltage connector of claim 1, wherein the first guiding member is provided with a first guide groove thereon.

3. The high voltage connector of claim 2, wherein the second guiding member is provided with a second guide groove thereon.

4. The high voltage connector of claim 1, wherein the shielding case has four prop members, such that in case of the shielding case being disposed to cover the terminal accommodating body, the four prop members sliding in the four guide slots so as to be consequently stopped by the four prop blocks, thereby being fixed in the housing body.

5. The high voltage connector of claim 4, wherein the terminal accommodating body further comprises:

a plurality of first slots, wherein the plurality of L-shaped conductive terminals are correspondingly inserted into the plurality of first slots by the insert portion thereof, so as to be fixed in the terminal accommodating body; and two second slots, wherein the two L-shaped signal terminals are correspondingly inserted into the two second slots by the insert portion thereof, so as to be fixed in the terminal accommodating body.

6. The high voltage connector of claim 1, wherein the outer flange further comprises a fool proof portion.

7. The high voltage connector of claim 6, wherein a plurality of connection holes are provided on the outer flange.

8. The high voltage connector of claim 7, wherein each of the plurality of connection hole is provided with a hole diameter adjusting sleeve.

* * * * *